US007238871B1

(12) United States Patent
Stroscio

(10) Patent No.: US 7,238,871 B1
(45) Date of Patent: Jul. 3, 2007

(54) GUITAR SLIDE POUCH

(76) Inventor: Frank Stroscio, 227 Bayberry Rd., Woonsocket, RI (US) 02895

( * ) Notice: Subject to any disclaimer, the term of this patent is extended or adjusted under 35 U.S.C. 154(b) by 0 days.

(21) Appl. No.: 11/361,919

(22) Filed: Feb. 24, 2006

(51) Int. Cl.
*G10D 3/00* (2006.01)

(52) U.S. Cl. ..... 84/329

(58) Field of Classification Search ..... 84/320–322, 84/315

See application file for complete search history.

(56) References Cited

U.S. PATENT DOCUMENTS 4,135,431 A 1/1979 Ferguson
4,328,733 A 5/1982 Smith
4,790,232 A * 12/1988 Rosen ..... 84/329
4,817,488 A 4/1989 de los Santos
D309,674 S 8/1990 Gervase
5,739,445 A 4/1998 Terry et al.
6,323,409 B1 11/2001 Surber
2006/0096440 A1 * 5/2006 Weathersby ..... 84/322

* cited by examiner

*Primary Examiner*—Kimberly Lockett
(74) *Attorney, Agent, or Firm*—Lawrence J. Gibney, Jr.

(57) ABSTRACT

This is a device to secure a slide to a slide guitar so that an individual may always have access to the means to play the instrument.

1 Claim, 3 Drawing Sheets

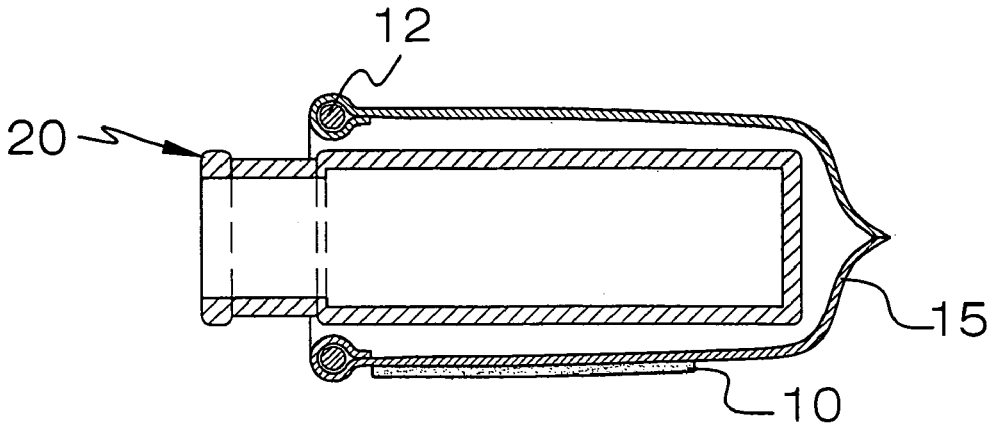
FIG. 3
FIG. 4
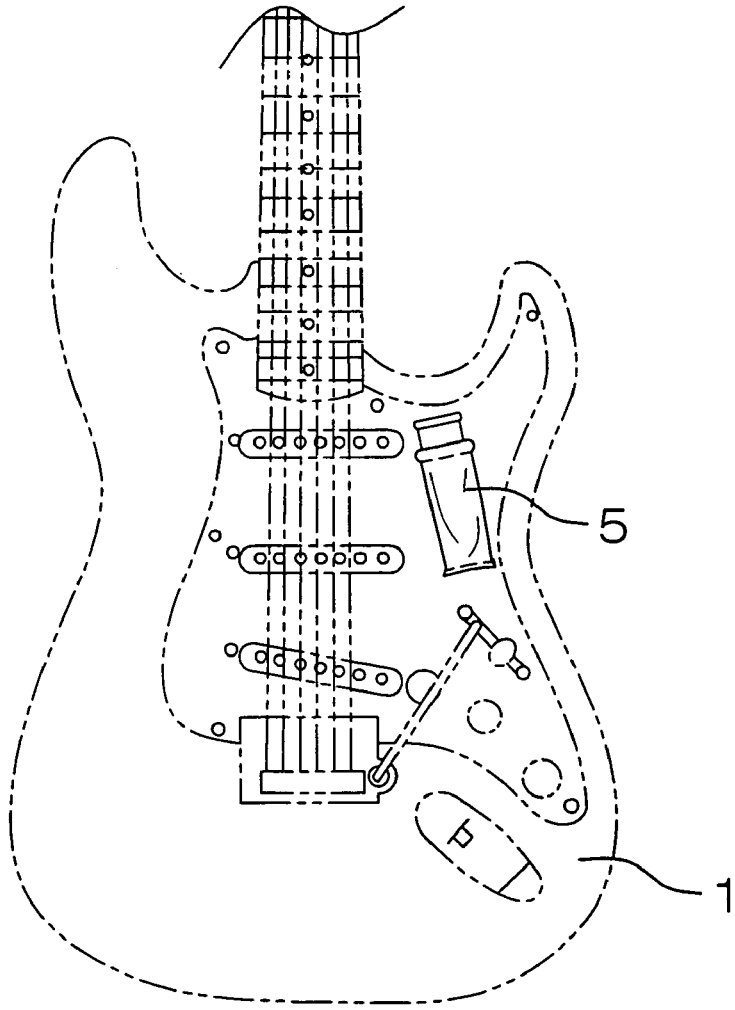

GUITAR SLIDE POUCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to playing a musical instrument and having the necessary means to play the instrument handy and convenient. Specifically, this relates to playing a slide guitar.

B. Prior Art

There are many other prior art references related to musical instruments, specifically guitars. A representative example of this type of device can be found at Smith, U.S. Pat. No. 4,328,733. This is a slide bar holder device for a Hawaiian guitar. The present application does not specifically relate to Hawaiian guitars.

Another example is a guitar slide bar apparatus that can be found at de los Santos, U.S. Pat. No. 4,817,488. Again, this specifically relates to a guitar slide bar apparatus, but it is not related to the storage of that particular apparatus. Another example of a guitar pick holder can be found at Gervase, Design 309,679. This has a completely different structure than the one in the current application. Another slightly different device is found in Ferguson, U.S. Pat. No. 4,135,431, which is a stringed musical instrument dispenser; the Ferguson device seeks to place a means to pick or play the instrument close to the individual. Other examples include Rosen, U.S. Pat. No. 4,790,232, and Surber, U.S. Pat. No. 6,323,409.

BRIEF SUMMARY OF THE INVENTION

This is a holder for a guitar slide. A guitar is played by plucking the strings that appear on the top of the guitar. A slide guitar is played by sliding the slide up and down the neck along the surface of the strings while picking the strings with the other hand to produce the desired sound. In order to effectively play the slide guitar the slide should be made convenient for the user.

With this device, the slide is placed in a pouch, which is secured to the top surface of the guitar. The slide is placed in the pouch for easy access. Additionally the placement of the device on the top of the guitar should not interfere with the sound of the guitar.

It is an object of this device to have the slide convenient for the individual while the individual is playing the slide guitar.

BRIEF DESCRIPTION OF THE DRAWINGS

FIG. 3 is a view according to line 3-3 on FIG. 1.

FIG. 4 is a top view of the guitar with the pouch with the slide in position.

DETAILED DESCRIPTION OF THE EMBODIMENTS

Guitar slides 20 have been around for a number of years. However, the practical problem with playing the slide guitar is that one must always find the means to play it i.e. the slide 20 in a convenient and timely fashion. This is particularly true while playing the slide guitar 1. While playing the slide guitar the slide 20 is placed over the strings and moved up and down the neck of the instrument to produce the desired sound. In order to keep the slide 20 convenient, this device has been devised.

Figure 1:
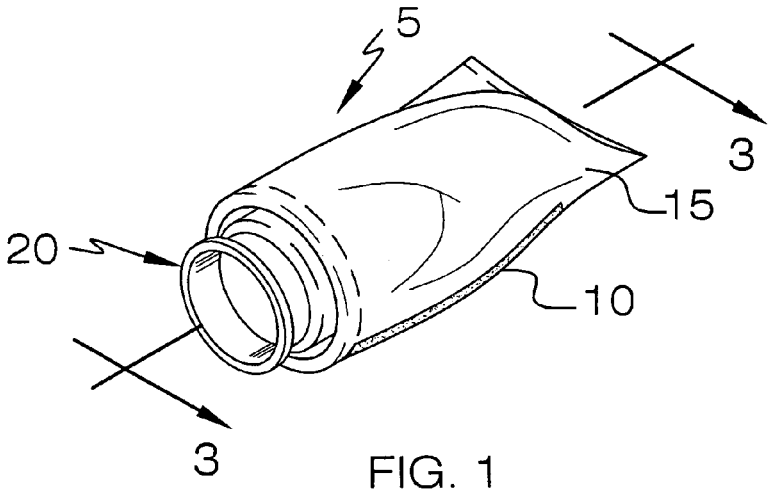
FIG. 1 is an isometric view of the slide and pouch.
Figure 2:
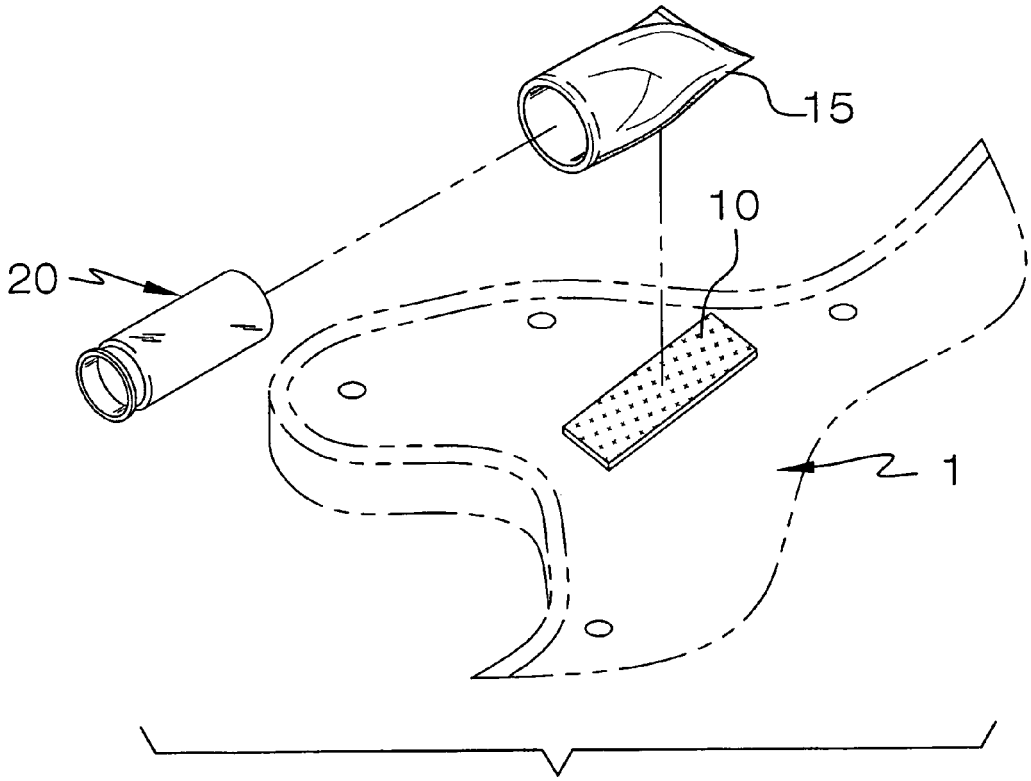
FIG. 2 is a fragmented exploded view of the slide and pouch secured to the body of the guitar.
Figure 5:
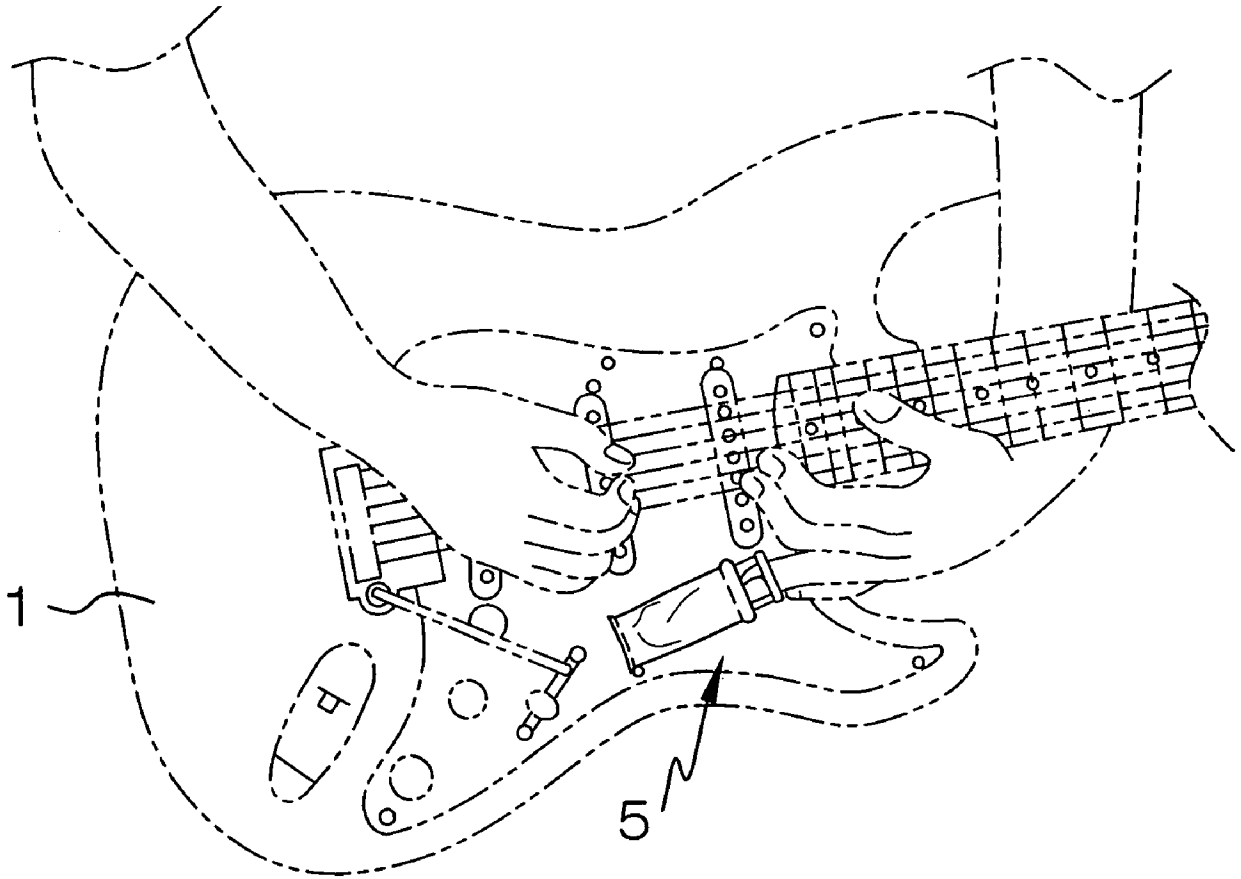
FIG. 5 is a front view of the device in use.

The slide 20 is placed in a pouch 15 of a predetermined shape with an opening on one end for the slide 20. The pouch is closed on one end and open on the other. FIG. 1 The pouch 15 is secured to the body of the guitar 1, using a means of attachment such as a hook-and-loop assembly 10 on one of the exterior surfaces of the pouch. Another means of attachment, such as a strap may also be used. One portion of the means of attachment 10 is placed on the guitar and other means is placed on an exterior surface of the pouch. FIG. 2 This means of attachment keeps the slide 20 with the pouch convenient at all times. FIGS. 4, 5

In order to ensure that the slide 20 remains in the pouch 15, a set of wires 12 around the opening will provide a predetermined amount of tension to ensure that the slide 20 does not drop out of the pouch 15. FIG. 3

Additionally, it should be noted that there will be no affect on the quality of the sound since the placement of this device will not adversely impact the playing of the instrument nor does it interfere with regard the operation of the slide or use of the strings.

The inventor claims:

1. A device for a slide guitar, which is comprised of:

a. a pouch;

wherein the pouch is of predetermined dimensions;

wherein the pouch has a first end and a second end;

wherein the first end is closed;

wherein the second end is open;

wherein the second end remains opens during use;

wherein a set of wires near the opening allow the second end to remain open during use;

wherein the pouch is secured to the body of the guitar with a means of attachment;

b. a slide;

wherein the slide is inserted into the opening of the pouch;

c. a means of attachment for the pouch;

wherein the means of attachment has a first part and a second part;

said means of attachment is a hook and loop assembly;

said first part is secured to the body of the guitar;

said second part is secured to one side of the outside of the pouch.

* * * * *